US012473900B2

(12) United States Patent
Colborn

(10) Patent No.: US 12,473,900 B2
(45) Date of Patent: Nov. 18, 2025

(54) HIGH VOLUME, LOW PRESSURE OILLESS PUMP

(71) Applicant: Setaysha Technical Solutions LLC, Magnolia, TX (US)

(72) Inventor: John Craig Colborn, Magnolia, TX (US)

( * ) Notice: Subject to any disclaimer, the term of this patent is extended or adjusted under 35 U.S.C. 154(b) by 666 days.

(21) Appl. No.: 17/833,861

(22) Filed: Jun. 6, 2022

(65) Prior Publication Data

US 2022/0389920 A1 Dec. 8, 2022

Related U.S. Application Data

(60) Provisional application No. 63/213,534, filed on Jun. 22, 2021, provisional application No. 63/197,650, filed on Jun. 7, 2021.

(51) Int. Cl.

| | |
|---|---|
| ***F04B 35/04*** | (2006.01) |
| ***F04B 27/00*** | (2006.01) |
| ***F04B 39/00*** | (2006.01) |

(52) U.S. Cl.

CPC ..... *F04B 35/045* (2013.01); *F04B 27/005* (2013.01); *F04B 39/0016* (2013.01)

(58) Field of Classification Search

CPC ... F04B 35/045; F04B 27/005; F04B 39/0016
See application file for complete search history.

(56) References Cited

U.S. PATENT DOCUMENTS

| | | | | | |
|---|---|---|---|---|---|
| 297,076 | A * | 4/1884 | Hardie | F04B 9/14 | 417/541 |
| 1,240,925 | A * | 9/1917 | Bennett | F04B 39/0016 | 417/259 |
| 1,439,503 | A * | 12/1922 | Clump | F16K 17/044 | 417/570 |
| 1,682,736 | A * | 9/1928 | Berry | F04B 39/0016 | 417/570 |
| 1,688,889 | A * | 10/1928 | Spreen | F04B 39/0016 | 137/516.21 |
| 1,764,655 | A * | 6/1930 | Spreen | F16K 15/028 | 137/533.19 |

(Continued)

FOREIGN PATENT DOCUMENTS

| | | |
|---|---|---|
| AU | 2017222445 B2 | 11/2021 |
| CN | 109069781 A | 12/2018 |

(Continued)

OTHER PUBLICATIONS

Wikipedia article titled "Silicone" (Year: 2020).*

(Continued)

*Primary Examiner* — Christopher S Bobish
(74) *Attorney, Agent, or Firm* — Timothy L. Scott, Esq.

(57) ABSTRACT

A motor and pumping system which provides for high volume, low pressure, low cost, and ease of assembly as a breathing air supply such as for a submerged diver. The integration of the necessary elements gives rise to a unique ability to eliminate costly and complex motor bearings and simplify the motor design by reducing number of magnetic poles and electrical control elements which would traditionally be required to control the multiple poles of an electromechanical machine.

17 Claims, 4 Drawing Sheets

(56) References Cited

U.S. PATENT DOCUMENTS 2,011,079 A * 8/1935 Replogle ..... F04B 39/1033 137/516.21
2,265,971 A * 12/1941 Talbert ..... B60C 23/10 92/240
2,382,716 A * 8/1945 Herzmark ..... F04B 39/064 137/340
2,984,190 A * 5/1961 Dibley ..... F04B 39/0016 417/511
3,286,911 A * 11/1966 Clarke ..... F04B 25/005 417/418
3,461,806 A * 8/1969 Barthalon ..... H02K 33/12 417/418
3,467,091 A 9/1969 Aragona
3,907,236 A 9/1975 Sims, Jr.
3,937,600 A * 2/1976 White ..... F04B 35/045 417/418
3,965,892 A 6/1976 Colston et al.
4,022,201 A 5/1977 Diggs
4,067,667 A * 1/1978 White ..... H02K 33/08 92/143
4,111,342 A 9/1978 Kirby
4,238,864 A 12/1980 Kealoha
4,245,632 A 1/1981 Houston
4,269,182 A 5/1981 Le
4,324,195 A 4/1982 Cunningham et al.
4,442,835 A 4/1984 Carnegie
4,472,082 A 9/1984 Kroling
4,674,493 A 6/1987 Mitchell
4,756,486 A 7/1988 Campbell
4,832,013 A 5/1989 Hartdom
4,986,267 A 1/1991 Doss
5,011,379 A * 4/1991 Hashimoto ..... F04B 43/04 417/418
5,067,920 A 11/1991 Brisky
5,173,067 A 12/1992 Biba
5,174,735 A * 12/1992 Gannaway ..... F04B 39/0016 417/570
5,193,530 A 3/1993 Gamow et al.
5,266,015 A * 11/1993 Gannaway ..... F04B 39/0016 417/570
5,297,545 A 3/1994 Infante
5,327,849 A 7/1994 Miller
5,351,681 A 10/1994 Hudson
5,354,187 A * 10/1994 Holland ..... B60T 8/4275 417/540
5,373,925 A 12/1994 Handford et al.
5,392,808 A 2/1995 Pierce
5,395,218 A * 3/1995 Thompson ..... F04B 27/005 92/159
5,452,994 A * 9/1995 Erickson ..... F04B 39/0016 417/550
5,471,976 A 12/1995 Smith
5,506,571 A 4/1996 Dugan
5,535,734 A 7/1996 Lu et al.
5,655,887 A * 8/1997 Chou ..... F04B 35/04 417/415
5,694,923 A 12/1997 Hete et al.
5,697,572 A 12/1997 Salentine et al.
5,924,416 A 7/1999 Miller
5,938,140 A 8/1999 Fundak
5,947,116 A 9/1999 Gamow et al.
5,996,578 A 12/1999 MacGregor
6,299,581 B1 10/2001 Rapoport et al.
6,323,568 B1 * 11/2001 Zabar ..... F04B 17/042 310/12.24
6,326,706 B1 * 12/2001 Zhang ..... F04B 35/045 310/12.32
6,817,359 B2 11/2004 Deas et al.
7,011,089 B2 3/2006 Tokatlian
7,159,528 B1 1/2007 Hilliker
8,007,256 B2 * 8/2011 Ishibashi ..... H02K 33/16 417/418
8,297,310 B2 * 10/2012 Ishibashi ..... F04B 39/06 417/418
8,770,951 B2 * 7/2014 Ishibashi ..... F04B 39/127 417/418
11,225,309 B2 1/2022 Colborn
2004/0163642 A1 8/2004 Tokatlian
2004/0168689 A1 9/2004 Kuriyama
2004/0255943 A1 12/2004 Morris et al.
2005/0268913 A1 12/2005 Morris et al.
2007/0039617 A1 2/2007 Buhlmann et al.
2008/0242162 A1 10/2008 Smith
2009/0056718 A1 3/2009 Lindgren
2010/0065055 A1 3/2010 Morris et al.
2011/0274571 A1 * 11/2011 Ishibashi ..... F04B 35/045 417/417
2011/0308523 A1 12/2011 Carmichael
2016/0347432 A1 12/2016 Smith
2018/0216504 A1 * 8/2018 De Mar ..... H02K 41/031
2021/0171168 A1 6/2021 Colborn
2022/0119083 A1 4/2022 Colborn

FOREIGN PATENT DOCUMENTS

DE 19741424 A1 5/1999
EP 0341085 A1 11/1989
EP 0437948 A1 7/1991
EP 3419709 A1 4/2021
EP 3419709 B1 4/2021
GB 2110566 A 6/1983
WO 1991001251 A1 2/1991
WO 1997010991 A1 3/1997
WO 1997012175 A1 4/1997
WO 2016094944 A1 6/2016
WO 2017147109 A1 8/2017
WO 2019109014 A1 6/2019

OTHER PUBLICATIONS

European Extended Search Report dated Jan. 31, 2019, European Patent Application No. 17757094.2 filed Sep. 24, 2018.
International Search Report dated May 16, 2017, International Patent Application No. PCT/US2017/018802 filed Feb. 22, 2017.
International Written Opinion dated May 16, 2017, International Patent Application No. PCT/US2017/018802 filed Feb. 22, 2017.
International Preliminary Report on Patentability dated Aug. 28, 2018, International Patent Application No. PCT/US2017/018802 filed Feb. 22, 2017.
Air Buddy, "Dive With The Ease Of Snorkeling Into The Fascinating World Underwater", found at: https://www.airbuddy.net/, Aug. 21, 2021.
Third Lung, "Brownie's Third Lung", found at: https://www.browniedive.com/store/p36/SEA_LION_-3_HOUR_FLOATING_HOOKAH_DIVING_SYSTEM.html, Aug. 21, 2021.
Diveandfish, "Powerdive Power Snorkel", found at: http://www.diveandfish.com.au/special/powerdive-power-snorkel.html, Aug. 21, 2021.
Keene Engineering, "Keene HydroAir Battery Powered Floating Compressor Diving System", found at: https://keeneeng.com/2016/09/27/keene-hydroair-12-volt-hookah-system/, Aug. 21, 2021.
Colborn, John, "Low Pressure Surface Supplied Air System and Method," U.S. Appl. No. 62/299,199, filed Feb. 24, 2016.
Communication Pursuant to Article 94(3) EPC dated Jul. 23, 2019, European Patent Application No. 17757094.2 filed Sep. 24, 2018.
International Search Report dated Mar. 5, 2019, International Patent Application No. PCT/US2018/0063440 filed Nov. 30, 2018.
Colborn, John, "Low Pressure Respiration Gas Delivery Method," U.S. Appl. No. 62/593,870, filed Dec. 1, 2017.
Communication under Rule 71(3) EPC dated Sep. 7, 2020, European Patent Application No. 17757094.2 filed Feb. 22, 2017.
Communication pursuant to Article 94(3) EPC dated Dec. 20, 2019, European Patent Application No. 17757094.2 filed Feb. 22, 2017.
Written Opinion dated Mar. 5, 2019, International Patent Application No. PCT/US2018/0063440 filed Nov. 30, 2018.

(56) References Cited

OTHER PUBLICATIONS

International Preliminary Report on Patentability dated Jun. 2, 2020, International Patent Application No. PCT/US2018/0063440 filed Nov. 30, 2018.
Office Action dated Feb. 22, 2021, Australian Patent Application No. 2017222445 filed Feb. 22, 2017.
Notice of Allowance dated Sep. 9, 2021, U.S. Appl. No. 16/100,058, filed Aug. 9, 2018.
Pre-interview First Office Action dated Jun. 28, 2021, U.S. Appl. No. 16/100,058, filed Aug. 9, 2018.
Colborn, John, "High Volume, Low Pressure Oilless Pump," U.S. Appl. No. 63/213,534, filed Jun. 22, 2021.
Colborn, John, "High Volume, Low Pressure Oilless Pump," U.S. Appl. No. 63/197,650, filed Jun. 7, 2021.
Notice of Allowance dated Sep. 12, 2022, U.S. Appl. No. 16/768,644, filed May 29, 2020.
Office Action dated May 24, 2022, U.S. Appl. No. 16/768,644, filed May 29, 2020.

* cited by examiner

HIGH VOLUME, LOW PRESSURE OILLESS PUMP

CROSS-REFERENCE TO RELATED APPLICATIONS

This application claims the benefit of priority to U.S. Provisional Patent Application No. 63/197,650, filed Jun. 7, 2021, entitled, "High Volume, Low Pressure Oilless Pump" and to U.S. Provisional Patent Application No. 63/213,534 filed Jun. 22, 2021, entitled, "High Volume, Low Pressure Oilless Pump" both of which are hereby incorporated herein by reference in their entirety.

BACKGROUND

The present invention is in the technical field of breathable gas delivery. More particularly, the present invention is in the technical field of delivering breathing gases used for underwater activities.

Surface Supplied Air, or "hookah" diving is a current means for underwater breathing akin to scuba diving, but the diver is tethered to the surface via a tube which delivers the breathing gases from a floating pump or pressurized tank. The current state of the art breathing methods for these technologies involve pressurizing the breathing gases at the surface using pumps that deliver gases in the range of 125 psi through a tube extending to the diver's depth, and from the tube to a mouthpiece-mounted pressure regulator, with a large pressure drop through a regulator inlet valve to the diver's local pressure at the point of delivery to the diver's mouth. However, at shallow depths the local pressure of the diver is much less than the intermediate pressure, in which case a great deal of the energy initially expended to compress the breathing gases to, e.g., 125 psi is largely wasted. For example, at a 30-feet water depth the diver's local pressure above atmospheric pressure is only 13 psi.

An exemplary prior art means of controlling the action and thus the energy consumption of a pump to compress air to high pressure, and to maintain a pressure in a tank or high-pressure supply lines between an upper threshold pressure and a lower threshold pressure, is illustrated by Carmichael et al. (U.S. 20110308523 A1). One or more divers may use the high-pressure air (e.g., in a tank or high-pressure tubes) via conventional second-stage scuba-type regulators and pressure-drop valves to reduce the (high) air pressure to the (lower) local pressure of the submerged diver. To avoid operating the pump continuously, a sensor is used to control the pressure in the reservoir between an upper and a lower pressure threshold. The sensor and associated logic causes the pump to turn on only when the air in the high-pressure tank or tubes falls below the lower threshold pressure, at which point the pump turns on and continues to operate until the pressure in the tank/tubes rises to the upper threshold pressure, when the pump is turned off. Although systems such as that of Carmichael et al. avoid the extremely high (e.g., ~3000 psi) pressures of scuba systems, the pressures involved are still relatively high, and typically even the lower pressure threshold is 50-75 psi or even higher.

The pump in systems such as that of Carmichael et al. is operated at pressures of e.g., 50-75 psi necessary to supply diving regulators at diving depths up to 60 ft.

High pressures are utilized in hookah equipment because the mouthpiece-mounted regulators used in hookah diving are adapted from scuba designs, which utilize even higher pressures in the body-worn scuba tanks (~3000 psi). To pressurize 1 cubic-foot of air from atmospheric pressure to 125 psi requires 386 Joules of energy. In comparison, pressurizing 1 cubic-foot of air from atmospheric pressure to 13 psi requires only 40 J; or ~10% of the energy. Hookah systems, which do not sense diver breathing, use conventional scuba-type pressure reduction valves to lower the pressure from the storage reservoir (e.g., a tank or high-pressure lines/hoses acting as a reservoir) pressure to the local pressure at the diver's depth.

The high overhead pressures used in scuba and hookah systems discussed above represents wasted energy, and manufacturers of hookah systems have endeavored to modify conventional second-stage scuba-type regulators to operate at lower pressures. More recently, hookah systems have been developed using specially prepared hookah mouthpiece regulators to operate in the 50-75 psi range. This is typically accomplished by modifying springs within the mouthpiece regulator to re-balance valve opening forces given the reduced pressures of hookah systems compared to scuba systems. While this represents a significant efficiency improvement over typical SCUBA mouthpiece regulators operating at pressures of, e.g., 125 psi, the 50-75 psi pressures of these hookah systems still represent a significant energy waste for relatively shallow diving depths of, e.g., 10-30 ft, where diver inhalation must overcome only 4.5-13 psi of prevailing water pressures at those respective depths. As noted, the difference between the pressure of the breathing gas supply source (e.g., the outlet pressure of a pump or the pressure in a tank or high-pressure hose reservoir) and the pressure that must be supplied at the diver's regulator to ensure adequate breathing gas during inspiration (functionally about 1-2 psi above the pressure of the diver's local external environment) is referred to herein as the overhead pressure. For example, if breathing gases are delivered at 75 psi to the regulator of a diver at 10 ft depth (4.5 psi local water pressure+1 psi), the overhead pressure is 69.5 psi. The overhead pressure is indicative of wasted energy.

A system for supplying breathing air to a submerged diver with overhead pressure of 5 psi or less, such as 4 psi, 3 psi, 2 psi or 1 psi or even less is published in International Application No. WO 2017/147109A1 (hereinafter the '109 application) in the name of the present applicant. The '109 application discloses a system having a floating pump to supply air to a submerged diver in response to sensed inspiration and/or expiration of the diver. The pump delivers breathing gases (e.g., air from the atmosphere) at a pressure that is only at or slightly above the local pressure of the diver (e.g., by ~1-2 psi), which at ten feet is only 4.3 psi, and only about 13.4 psi at 30-ft water-depth. Because the pressures are modest and there is little or no overhead pressure in system of the '109 application, no letdown valve is used and the pump only develops the pressure necessary to deliver the breathable gas at the diver's depth (i.e., the pressure of the diver's local environment at the particular diving depth plus about 1-2 psi to overcome frictional losses in the tube/hose and regulator), greatly reducing the energy required by the pump compared to scuba or hookah systems.

The method described in the '109 application is shown to be superior to any other hookah system in reduced size, cost, and complexity and was first commercialized in 2019 as the Nemo by BLU3, Inc. However, commercial experience has revealed weaknesses in the pump design of the system described in the '109 application. The present disclosure provides particular configurations of a high-volume, low pressure pump with unique features intended to fully utilize the methods of air delivery to an underwater diver described in the '109 application, but with a pump design that is superior in size, cost, complexity, and performance to any other known implementation.

The present invention provides a pump capable of delivering compressible breathing gases to a submerged diver with lower manufacturing costs, a reduced part-count, a smaller volume, and a lighter overall system weight while achieving superior pumping performance compared to existing commercial designs. The disclosed configuration is easily expandable to create higher pressures enabling greater diving depths by simply extending the length and number of magnetic poles in the motor.

SUMMARY OF THE INVENTION

In one embodiment, the present invention is an integrated motor and pump capable of delivering 3 cubic feet per minute (cfm) of air at 13.5 psig using a DC supply voltage less than 60V.

In one embodiment, the present invention is a linear motor smaller than 4.5 inches in any dimension, and capable of continuous operation in 90 deg F. ambient temperatures at under 60VDC and over 500 Watts continuously without any means of active cooling.

In one embodiment, the present invention is a permanent-magnet linear motor with a segmented cage magnetic flux path which exposes electromagnetic coils for enhanced cooling using a fluid medium such as air or water to passively cool the electromagnetic coils.

In one embodiment, the present invention is a two-cylinder motor and pump configured with no motor or pump bearings. In one preferred embodiment, a piston assembly having first and second pistons at opposing ends are linked by a connecting rod to form a single piston assembly for reciprocating travel within a single bore, with each piston operating as a separate piston at the ends of the bore. In one embodiment, the piston assembly includes at least two permanent magnets, which interact with an electromagnet coupled to an exterior of the cylinder bore.

In one embodiment, the present invention is a linear motor and pump configured with expandable motor elements and pumping cylinder diameters without the need to change common parts.

In one embodiment, the present invention is a two-cylinder linear pump configured with one-piece, oilless pistons.

In one embodiment, the present invention is a permanent-magnet electric motor configured with toroidal magnetic flux paths whose centers are coaxial with two pumping cylinders.

In one embodiment, the present invention is a permanent-magnet linear motor whose magnetic circuit is configured to cause passive-cog forces to be additive to the forces necessary during the compression stroke, as discussed in greater detail in connection with FIG. 3 below.

In one embodiment, the present invention is a permanent-magnet linear motor configured to achieve one pumping stroke with only one electromagnetic pole transition.

In one embodiment, the present invention employs a 3:2 ratio of permanent-magnet: electro-magnet nodes to achieve simplified design and fabrication.

In one embodiment, the present invention is a permanent-magnet linear motor configured to achieve operational forces with not more than three permanent-magnet and two electromagnetic poles.

In one embodiment, the present invention is a pump whose mechanical volumetric changing geometry (e.g., piston) is unconstrained in its position relative to the cylinder bore by a drive member (whereas prior-art piston positions are constrained by attachment to a connecting rod whose position is limited by a crank-shaft).

In one embodiment, the present invention is a pump whose mechanical volumetric changing geometry (e.g., piston) is decelerated and captured in a passive manner.

In one embodiment, the present invention is a pump whose mechanical volumetric changing geometry (e.g., piston) is decelerated without physical contact with any other moving part In one embodiment, the present invention is a pump whose mechanical volumetric changing geometry (e.g., piston) is decelerated by a system that passively transfers at least a portion of the excess kinetic energy associated with the moving piston into the pumped fluid.

In one embodiment, the present invention is a permanent magnet linear pump configured such that entrained liquids are expelled with gravitational and airflow means.

BRIEF DESCRIPTION OF THE DRAWINGS

Illustrative embodiments of the invention are described herein. In the interest of clarity, not all features of an actual implementation are described in this specification. In the development of any such actual embodiment, numerous implementation-specific decisions must be made to achieve the design-specific goals, which will vary from one implementation to another. It will be appreciated that such a development effort, while possibly complex and time-consuming, would nevertheless be a routine undertaking for persons of ordinary skill in the art having the benefit of this disclosure.

Certain terms are used throughout the following description and refer to particular system components. As one skilled in the art will appreciate, components may be referred to by different names. This document does not intend to distinguish between components that differ in name but not function.

FIG. 1A is a section view showing the internal components of one embodiment of the present disclosure.

FIG. 1B is an orthogonal view showing the externally-viewable elements of an embodiment according to the present invention.

DETAILED DESCRIPTION OF THE INVENTION

In one aspect, embodiments of the present invention overcome limitations of commercially available breathing air pumps for diving applications. The present invention incorporates low cost, readily available raw materials to provide a pump capable of achieving pumping performance sufficient for diving depths of thirty feet or greater when employed in a system as described in the '109 application. The particular configurations of the disclosed elements allows the user the benefit to reach 30-ft diving depths with equipment weighing approximately 10 lbs—about ⅛ the weight of conventional scuba equipment. The illustrative configuration makes extensive use of symmetry such that one part may serve in multiple places within the pump and motor to reduce production cost and system complexity.

Embodiments of the present disclosure may utilize a logic unit (e.g., a controller or processor such as a microprocessor or field programmable gate array) capable of processing executable code (e.g., firmware or software) to control the actions of the electromagnetic elements and thus to control motor stroking. In a controller processing executable code, decision logic, sensory, and control mechanisms are employed for appropriate management of pump stroking speed and the position and movement of the pistons to pump compressible breathing gases (e.g., air) to a submerged diver.

Figure 1A:
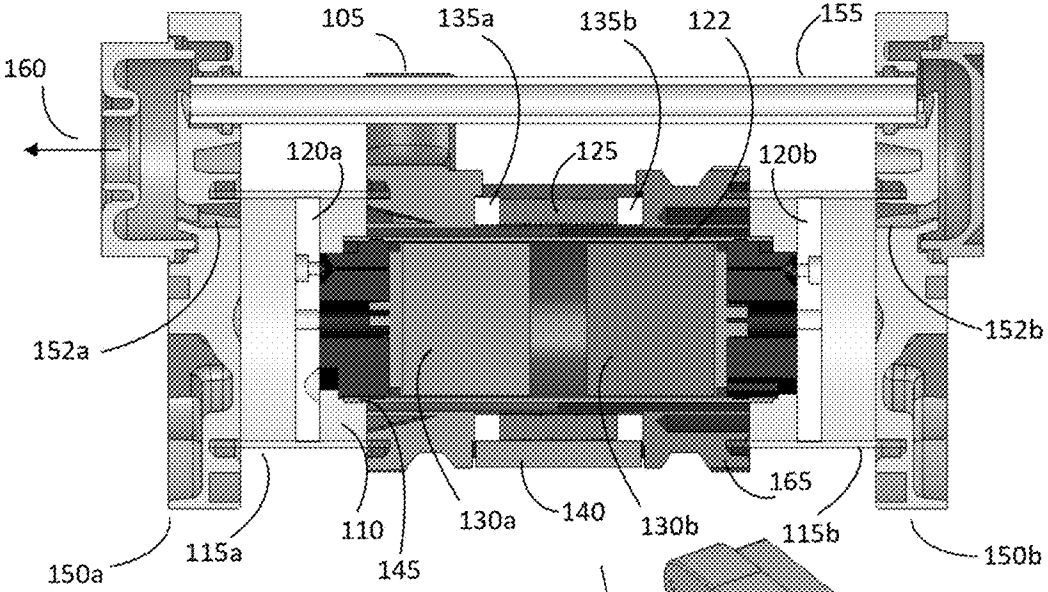
FIGS. 1A and 1B together provide a functional illustration of an embodiment of a high volume, low pressure linear pump according to the present disclosure.
Figure 1B:
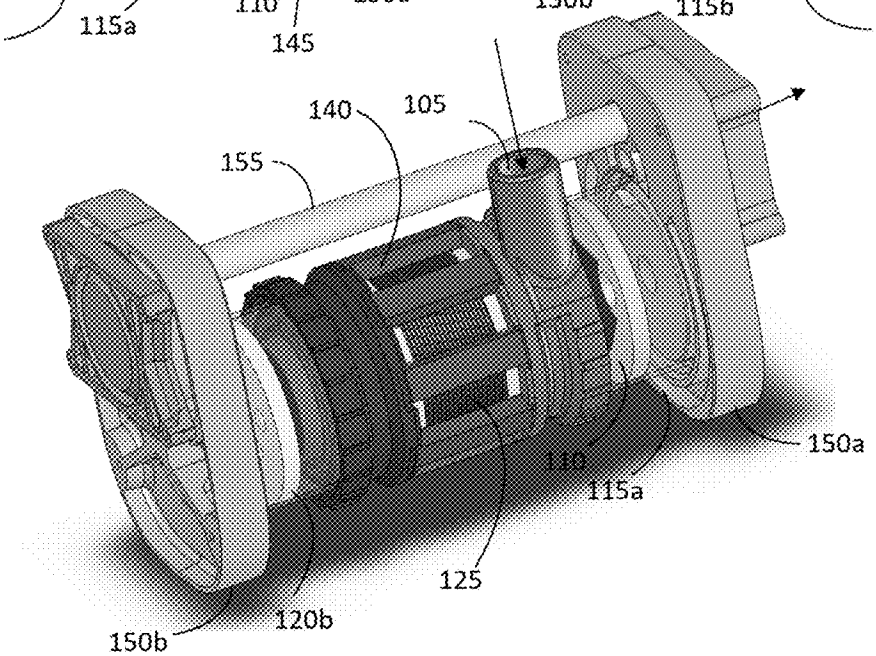

FIG. 1 illustrates an embodiment of a pump system to achieve the pumping advantages described above. Air enters through inlet (or intake) 105, and preferably passes along the inside of the electromagnetic motor coil 125 so as to provide a cooling action to the coils. Air passes from the inlet 105 to an inlet side 110 of a piston such as the left-side piston 120*a* in FIG. 1*a*. A passage (not shown in FIG. 1), allows air to flow from the intake-side 110 of the piston to the pressure-side of the piston (e.g., piston 120*a*) during the intake stroke of the piston, while a check valve (also not shown in FIG. 1) prevents movement of the air back to the inlet side 110 during the compression stroke. As voltage is applied to the electromagnetic motor coil 125, a magnetic field is induced around the coil and concentrated within the elements of the magnetic circuit including the motor core rings 135*a*, 135*b* and the motor core cross-bar(s) 140.

It will be appreciated to those of skill in the art that electromagnets may be energized in either of two voltage polarities, causing current flow in opposing directions, and thereby causing two possible directions of magnetic polarity. As illustrated, the magnetic poles North or South are concentrated in the motor core rings 135*a/b*, according to the direction of electrical current flow within the electromagnetic motor coil 125.

Permanent magnets 130*a* and 130*b* are positioned inside a connecting rod 145 linking the pistons 120*a*, 120*b* into a single piston assembly 122. In a preferred embodiment, like poles of the permanent magnets 130*a*, 130*b* are facing toward the middle of the piston assembly, e.g., the south pole of magnet of 130*a* faces the south pole of magnet 130*b*. This configuration causes an extremely high magnetic field flux density in the region of the opposing poles, and the high flux density allows for high mechanical forces to be achieved. In the embodiment of FIG. 1, the foregoing elements (e.g., permanent magnets 130*a* and 130*b*, connecting rod 145, and pistons 120*a* and 120*b*) are illustrated in a circular cylindrical shape. In alternative embodiments, other shapes may be used (e.g., non-circular cylinders, etc.). Together, magnets 130*a*, 130*b*, pistons 120*a*, 120*b*, and connecting rod 145 form a piston assembly 122 that moves as a unit, with pistons 120*a* and 120*b* reciprocating within cylinders 115*a* and 115*b*, respectively.

The electromagnetic motor coil 125 may be energized in either of two voltage polarities, causing attractive and repulsive forces in interaction with the nearby permanent magnets 130*a*, 130*b* as described in greater detail in FIG. 2. Current flow in different directions in electromagnetic motor coil 125 thereby causes electromagnetic polarities which either repel or attract the adjacent permanent magnets 130*a*, 130*b*, which results in movement of the connecting rod 145 and, by extension, pistons 120*a* and 120*b* coupled to the connecting rod. In one embodiment, manufacturing and coil-winding operations may be simplified by using spool-shaped electromagnetic motor coil 125, and by using all disc and cylindrical structures in the magnetic circuit(s), forces of attraction and repulsion remain symmetrical and balanced, avoiding the need for exquisite and costly bearing components.

When the electromagnetic motor coil 125 is successively energized in alternating polarities, the connecting rod 145 is caused to move either leftward or rightward, and thereby pistons 120*a*, 120*b* coupled to the connecting rod 145 are caused to move inside cylinders 115*a*, 115*b*, resulting in a compression stroke for one piston simultaneously with an intake stroke for the other piston. The movement of the pistons 120*a*, 120*b* within the cylinders 115*a*, 115*b* causes the movement and compression of breathing gases (e.g., air) inducted into inlet 105 for the purposes of supplying breathing gases to a submerged diver.

In one embodiment, one-way flow valves (not shown in FIG. 1) are located to preferably cause one-way flow from the intake-side of the pistons to the pressure-side of the pistons. In a preferred embodiment, a resilient one-way valve (e.g., an elastomeric umbrella valve, discussed in greater detail in connection with FIG. 4) serves simultaneously as an elastic or energy-dissipating end stop in the event that the pistons 120*a*, 120*b* travel to the ends of their respective cylinders 115*a*, 115*b* and collide with the corresponding piston heads 150*a*, 150*b*. In one embodiment, a simple one-way flapper valve (not shown) on the pistons 120*a*, 120*b* ensures that air flows only from the intake side 110 of the pistons to the pressure side, where it is delivered to a common header 160 for delivery to the diver. Piston heads 150*a*, 150*b* provide closure to the ends of the cylinder(s) 115*a*, 115*b* and contain the compressed breathing gases (e.g., air) caused by the movement of the pistons 120*a*, 120*b* and the operation of one-way valves such as those depicted in FIG. 4 as 426 to prevent pressurized air from returning back into the cylinder(s).

In one embodiment, a conduit tube 155 conveys pressurized air from one cylinder (115*b* in the embodiment of FIG. 1) to the other end of the pump where it can be delivered to a common discharge location 160 receiving air from both cylinders 115*a* and 115*b*, which may be configured for hose or other connection for delivery of the compressed breathing gas to a submerged diver.

The motor core elements serving as elements of the magnetic circuit (e.g., motor core rings 135*a*, 135*b* and motor core cross-bars 140 must be constructed of magnetically susceptible material preferably ferromagnetic stainless-steel, silicon steel, magnet steel, ferrite, or soft iron. In some embodiments, motor core cross-bars 140 may be omitted.

Preferably the motor core cross-bar element(s) 140 are spaced such that their volume is sufficient so as to not be fully magnetically saturated in light of maximum magnetic flux, but also so as to leave openings which give the electromagnetic motor coil 125 windings the best possible exposure to the surrounding environment to exhaust waste heat.

In a preferred arrangement, the windings of electromagnetic motor coil 125 are situated beneath the surface of the water in the diver's environment, and a thin protective coating (e.g., a polymer) serves to isolate the windings from the corrosive effects of water (including without limitation salt water) while maximizing the removal of waste heat from the windings of coil 125 to the surrounding environment (e.g., water).

In an alternate arrangement (not shown), additional electromagnetic elements may be replicated along the central axis without the need to re-design the other components, e.g., air inlet or intake 105. By providing additional electromagnetic components (e.g., using a third permanent magnet 130*c* (not shown) in addition to permanent magnets 130*a* and 130*b*, and a second electromagnetic motor coil 126 (not shown) in addition to electromagnetic motor coil 125), the effective stroking force may be increased, thereby allowing increased breathing gas pressures and/or air flow to a diver, or in some embodiments to supply air to multiple divers. In a preferred embodiment, the components (e.g., inlet or intake 105) are shaped to accommodate multiple or different diameters or sizes of cylinders 115*a*, 115*b* without the need to re-design these components. In another embodiment, the central diameter about-which the motor coil 125 is wound is comprised of an insert which allows use of varying sizes and/or shapes of permanent magnets 130*a*, 130*b* and connecting rods 145 without the need to re-design the other components.

Figures 2A, 2B, 2C:
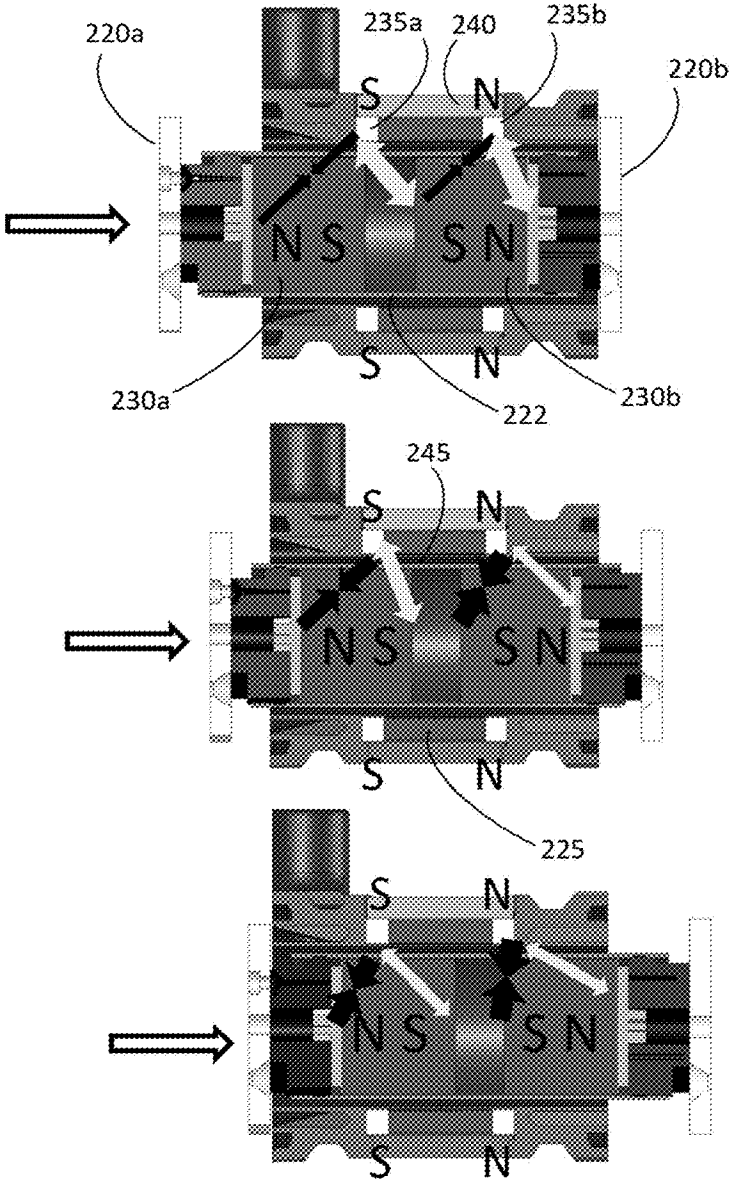
FIGS. 2A-2C provide an illustration of magnetic forces of the pump of FIGS. 1A and 1B while the pump is stroking from far left (FIG. 2A), to middle-of-stroke (FIG. 2B), and further forcing rightward to the far right of stroke (FIG. 2C).

FIGS. 2A-2C illustrate the relative positioning of electromagnetic poles and permanent magnetic poles of a piston assembly 222 at different positions of the pistons 220*a*, 220*b* in an exemplary configuration of a pump embodiment of the present disclosure, in cross-section view. For simplicity, the piston assembly is shown without corresponding cylinders, which would be present in an actual implementation. The electromagnetic poles are shown as arrows of attracting forces (N+S) or opposing forces (N+N and S+S). The magnitude of magnetic forces is greater with close proximity, and less with greater distance, as illustrated by relative arrow widths, respectively.

If FIG. 2A, the piston assembly 222, including permanent magnets 230*a*, 230*b*, pistons 220*a*, 220*b*, and a connecting rod 245, is shown at its left-most position. Electromagnetic forces generated by the interaction of a magnetic field induced in motor core rings 235*a*, 235*b* (by electromagnetic motor coil 225) and the magnetic fields of permanent magnets 230*a*, 230*b*, driving the piston assembly rightward, as shown by the arrow on the left hand side of the figure.

If FIG. 2B, the connecting rod and pistons are shown at their mid-point position, but the having electromagnetic forces driving the piston assembly rightward.

If FIG. 2*c*, the connecting rod and pistons are shown at their right-most position, with electromagnetic forces illustrated by the arrows continue to drive the piston assembly 222 rightward.

While FIG. 2 is shown in two-dimension cross-sectional view, the elements depicted (e.g., pistons 220*a*, 220*b*, permanent magnets 230*a*, 230*b*, and motor core rings 235*a*, 235*b*) are cylindrical or toroidal in three-dimensional shape, and the exemplary forces depicted are actually symmetrically distributed as toroids in 3-dimensional space, with their central axis along the axis of the piston assembly 222, including pistons 220*a*, 220*b*. In this way, all net forces are in the direction of beneficial work. In contrast, typical rotating machines such as pumps with connecting rods connected to a reciprocating member utilize bearings or members to convey forces, which occur off-axis to the work being performed. These bearings add cost and, importantly for the diving application, must be lubricated and are prone to fouling from the ubiquitous presence of water inherent in the diving environment. For diving applications, lubricants inside pumps also represent a risk to diver safety in the event that lubricant enters the breathing gases/air, and a preferred diving pump avoids the use of liquid lubricants altogether.

Because permanent magnets 230*a*, 230*b* exert magnetic forces even in the absence of electrical energy being applied to electromagnetic motor coil 225, and because motor core rings 235*a*, 235*b* and motor cross-bars 240 convey magnetic fields more readily than the surrounding copper, plastic, or air, the pump has a bi-stable behavior at either end of travel. At the far-left position depicted in FIG. 2A, the central south pole of the permanent magnets finds a lowest energy point when the flux travels through 235*a*->240->235*b* and returns to the permanent magnet 230*b*'s north pole. Similarly, at the far-right position shown in FIG. 2C, the south poles of permanent magnets 230*a*, 230*b* find a lowest energy by traveling through 235*b*->240->235*a* to the permanent magnet 230*a*'s north pole. This tendency for magnetized elements of an electromechanical machine (motor) to encounter forces even in the absence of being energized is termed "cogging" behavior. When the connecting rod 245 and pistons 220*a*, 220*b* are in their central position as shown in FIG. 2B, the forces are all symmetrically balanced, and there is no cogging force. However, this position is a highly unstable state with a propensity to snap to either left—(i.e., FIG. 2A) or right—(i.e., FIG. 2C) lower-energy positions.

In the illustrated scenario where the pistons are traveling from left (FIG. 2A) to right (FIG. 2C), the left-side piston 220*a* is performing an intake stroke and produces little or no work. However, the right-side piston 220*b* traveling in the same direction is performing a compression stroke, and the act of traveling rightward causes a pressure increase to the right side (e.g., the pressure side) of piston 220*b* within the cylinder (not shown). It will be appreciated that the processes and roles will be reversed in the case where the motor stroke is occurring in the opposite (i.e., leftward) direction (not shown in FIGS. 2A-2C).

In FIG. 2A, in order to cause rightward movement, the electromagnetic forces generated at motor core rings 235*a* and 235*b* by the action of electric current in the electromagnetic motor coil 225 must overcome i) the cog forces which tend to keep it at the left-most bistable position, and ii) the pressure-related force encountered in the compressing of breathing gases/air by the right-side piston. This is the case until the cog forces reduce to neutral/balanced at the mid-point of stroke, FIG. 2B. As the piston continues progressing rightward beyond the mid-point, the bistable cog force combines additively with the electromagnetic force created by the interaction of the electromagnet forces in the motor core rings 235*a*, 235*b* and the permanent magnets 230*a*, 230*b*. This is particularly advantageous near the end of the stroke because it is where increasing pressures of the compressed gas and continued rightward positioning of the right-side piston cause counter-forces attributable to increasing pressures.

By configuring the magnetic circuit elements (e.g., electromagnetic motor coil 225, motor core cross-bars 240, motor core rings 235*a*, 235*b*, and permanent magnets 230*a*, 230*b*) as described in FIGS. 1A, 1B, and FIGS. 2A-2C, the disclosed pump and motor takes advantage of normally deleterious cog forces to achieve higher pumping pressures by positioning the magnetic and electromagnetic elements so as to utilize cog forces additively with the electromagnetic forces in areas of the pumping stoke where they are most additive to the pumping goals (e.g., near the end of the stroke to maximize pressure.)

In one embodiment, by configuring the magnetic circuit elements to accomplish the stroking distance of one pumping stroke equating to the effective working distance of one magnetic pole transition, the design achieves a simpler and lower cost assembly process by requiring only one electromagnetic coil, and simpler and lower cost electrical controls and logic control circuitry requiring the management of only one magnetic pole/phasing (whereas typically at least three phases with reverse are required for motor operation).

Figure 3:
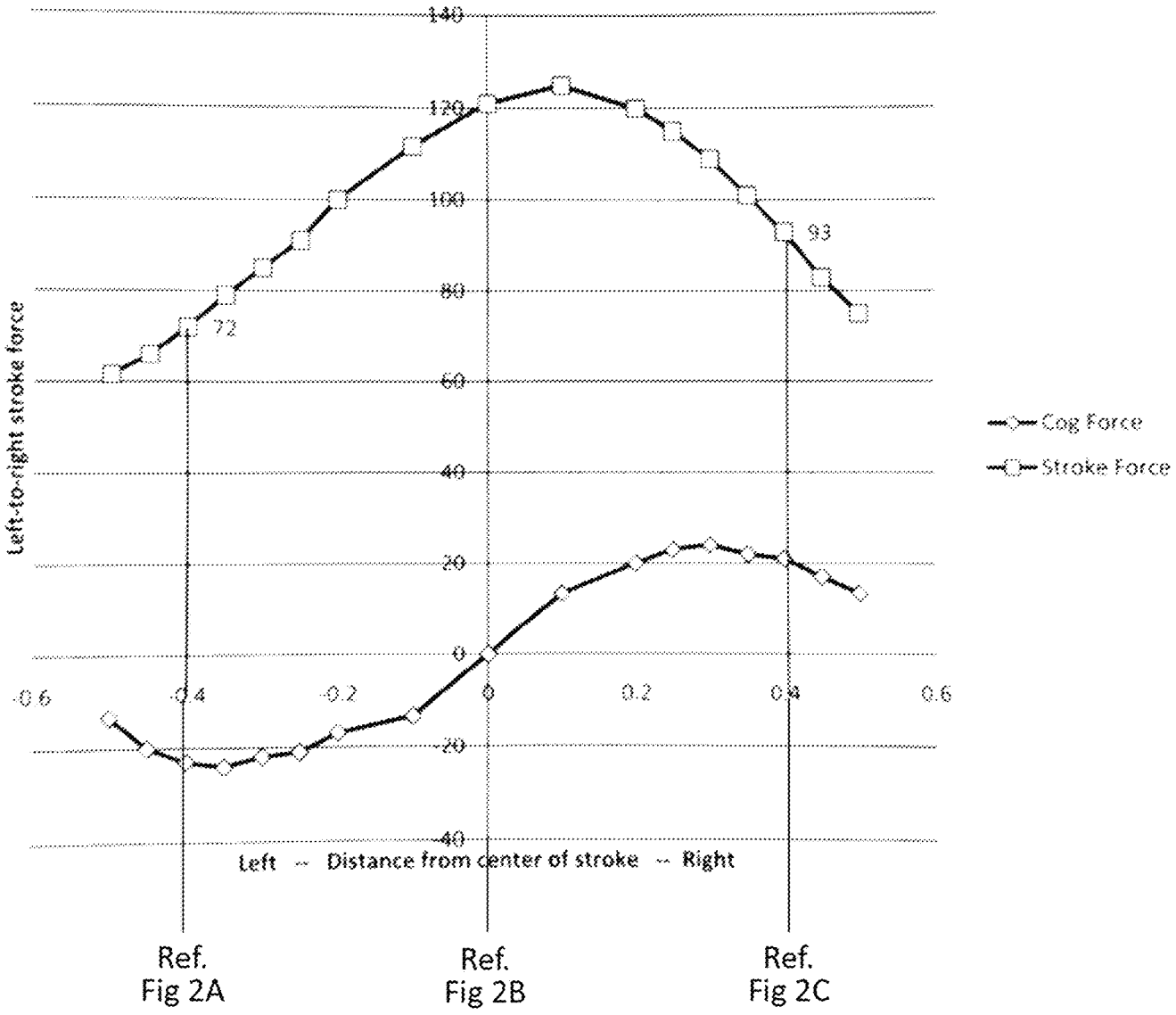
FIG. 3 is an exemplary graph of force vs displacement for both passive cog forces, and for left-going-rightward stroking force.

FIG. 3 presents a data graph of forces on the vertical axis, vs position of the pistons/motor elements on the horizontal axis. The center position (corresponding to that depicted in FIG. 2B) is denoted as zero, with leftward positions (corresponding to leftward positions depicted in FIG. 2A) denoted as negative displacement e.g. inches from the center, and rightward positions (corresponding to positions depicted in FIG. 2C) depicted as positive displacement e.g. inches from the center. The data in FIG. 3 represents the condition of the motor/pistons beginning at the left, and using electromagnetic force to cause active rightward motion. As depicted, the Cog Force shows a negative force on the left-side of the graph, indicating that the cog force (lower curve) is resisting (subtracting from) rightward movement stroke force (upper curve). Conversely, on the right-side of the graph, the Cog Force shows positive values, indicating that the Cog Force is additive to a rightward active electromagnetic stroke force generated by electromagnetic motor coil 125 creating electromagnetic poles at motor core rings 235*a*, 235*b*. Whereas the electromagnetic stroke force of the upper curve is present only during current-flow in the windings of electromagnetic motor coil 125, and is reversible depending on the direction of current-flow in the windings of coil 125, the cog force persists passively regardless of the presence or absence of current flow through the windings of coil 125. It will be appreciated that FIG. 3 presents only the left-to-right electromagnetically-activated scenario for brevity of illustration and that movement in the opposite direction will be symmetrically opposite to the curves depicted.

FIG. 3 illustrates the results of the physical configuration taught in FIG. 2. In a specific embodiment, the motor and pumping stroke length is 0.8 inches; +/−0.4 inches from the center. The Stroking Force is the sum of the Cog Force shown in the lower curve, and the electromagnetic Stroke Force being driven by electrical current passing through the windings of electromagnetic motor coil 225. For the pump beginning on the left (FIG. 2A position) and proceeding rightward, the left-side piston is performing an intake stroke and encountering substantially no resistance, while the right-side piston is performing a compression stroke and encountering increasing resistance as it proceeds rightward. The right-side piston 220*b* is the one to which the motor must provide energy (i.e., stroke force) to accomplish the air compression to supply air to, e.g., a submerged diver. The right-side piston, then, starting from the left (e.g., position −0.4) is able to accomplish a net stroke force of 72 pounds force in the rightward direction. The piston has no resistive pressure at the beginning of the compression stroke, but as the piston proceeds rightward, the air pressure in the right-side chamber builds and causes an increasing force of resistance. The electromagnetic elements are configured to increase the Stroke Force to a peak at near to the center of the stroke where greater force is needed to accelerate and build momentum in the motor's moving parts—including the weight of the magnets and pistons. As the piston approaches end of travel on the right side of stroke, there is a need to decelerate the piston assembly to avoid impacting (and possibly damaging) the cylinder head (e.g., 150*b*, FIG. 1) at the end of the piston cylinder 115*b*, and but also a need for continued force at the right-most piston location to overcome and continue to provide compression until the end of stroke.

FIG. 3 illustrates that the physical configuration taught in FIG. 2 provides for continued stroking force at the compression-side of the stroke (+0.4 inches=93), at the cost of lower forces at the beginning of the stroke (−0.4 inches=72), and at the location where the lower force is not needed (at the beginning of stroke; before any compression resistance forces) in consideration of the function in the pumping application. The stroke locations and forces described herein are exemplary of one configuration for the sake of illustration and are to be considered nonlimiting.

The Cog Force on the right side of the FIG. 3 graph teaches that magnetic cog forces (lower curve) act in the same direction of pumping on the right side of stroke center (as represented by positive values of Cog Force on the right side of the Figure). Even when electromagnetic stroke forces are not present (i.e., when no electrical current is flowing in electromagnetic motor coil 225), the permanent-magnet forces are pulling the piston rightward with up to 20 pounds-force (as illustrated, for example, at position 0.4). In practice there are times of use when the forces from pumped-medium (e.g., air) pressures counteracting the piston travel are less than the cog forces, and the piston impacts the head/cylinder structures of the pump (e.g., piston head 150*b*, FIG. 1). In this case, there is a need to limit the energy dissipated as a result of the piston impacting the head/cylinder at the end of travel.

In one embodiment, the piston assembly 222 is constrained by the pump geometries and pistons 220*a*, 220*b* are allowed to impact the cylinder/head at the end of travel, which may cause damage and reduced pump life. Depending on the intended use and endurance of the pump, this can lead to wear and pump failure before the intended use duration.

In one embodiment, the electromagnetic driving forces (e.g., the Stroke Force shown in FIG. 3) are reduced or eliminated before the end of the stroke to reduce impact energy. In another embodiment, the electromagnetic driving forces are reversed such that electromagnetic stroke forces stop or decelerate the piston before colliding with the head/cylinder at the stroke end. This is a tradeoff of energy efficiency for wear (because energy is used to decelerate the piston assembly in addition to continuing to perform pumping work) but is effective to eliminate wear to pump components.

In another embodiment, the switches for the electromagnetic windings are caused to act as a short-circuit or resistive path in lieu of applying driving-voltage or reversing-voltage to the electromagnetic windings at a phase of pump stroke after the center of stroke and before the end of stroke. When the permanent magnets (e.g., 230*a*, 230*b*) move versus a shunted coil wire (or any electrical conductor), a counter-force is generated as described by Lenz's Law. The act of changing the electromagnet(s) driving switches from driving, to shunting, and finally reversing the current flow before piston collision with other pumping structures, is effective to reduce or eliminate impact damage and wear. Braking (shunting the coils utilizing Lenz's Law to decelerate the piston) is accomplished with no detriment to energy consumption, but the excess energy is dissipated as heat in the electromagnetic coils, and does not result in complete stoppage of movement.

In a preferred embodiment, motor switches are reconfigured in the latter phase of the stroke to cause the movement of the permanent magnets (e.g., 230*a*, 230*b*) against the electromagnetic motor coil 225 windings to become a generator, and generated electrical energy which would have otherwise been dissipated as impact energy and wear or heat energy in the shunted coils is recaptured (e.g., into batteries) for later use (e.g., to perform pumping work). The method of reconfiguring the electrical circuit of battery discharging into a motor to alter the system behavior such that the motor behaves as a generator pushing current into a battery is commonly referred-to as Regenerative Braking in electric vehicle systems. In this embodiment of the present disclosure, a similar circuit reconfiguration is used in a novel way to decelerate a pump at the end of the compression stroke.

FIGS. 4A-4D illustrate a portion of a linear motor pump 400 having a passive deceleration system to control pumping stroke and dissipate excess energy if the piston forces overcome the counter-forces of the pressurized medium being pumped. Because the linear motor's piston is not positively-controlled in its position by a traditional crankshaft and connecting rod, the piston may collide with the end of the cylinder whenever the piston's progressing forces exceed the forces of pressure countering the piston's movement. FIG. 4A-4D presents illustrative cross-section views of typically cylindrical components.

Figure 4A:
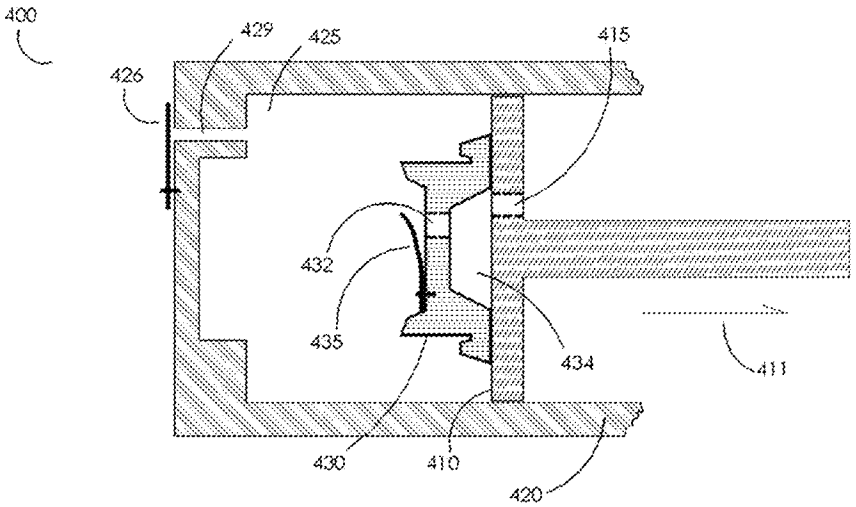
FIGS. 4A-4D together illustrate a passive system for decelerating a moving piston by a bumper and recess with one-way valves to transfer at least a portion of the kinetic energy of the moving piston to the pumped fluid.

FIG. 4A illustrates a piston 410 moving rightward and performing an intake stroke 411 in a cylinder 420. In one embodiment, air enters cylinder compression chamber 425 through the piston passageway 415 from the right side of the piston 410, which is coupled to an inlet (e.g., inlet 105 of FIG. 1, not shown in FIG. 4), traverses through chamber 434 and air passageway 432 of a bumper 430 coupled to piston 410, and into the chamber 425. The bumper 430 may also allow one-way airflow at the location where the bumper 430 touches the piston 410 in the same manner as an umbrella valve. As air passes from the inlet side of piston 410 to the cylinder compression chamber 425, bumper one-way valve 435 opens to allow air into the chamber 425, and cylinder one-way valve 426 blocks the exit from the chamber 425 during the intake stroke 411. The passage of intake air traversing bumper 430 via cavity 434 and port 432 provide beneficial cooling to the bumper.

Figure 4B:
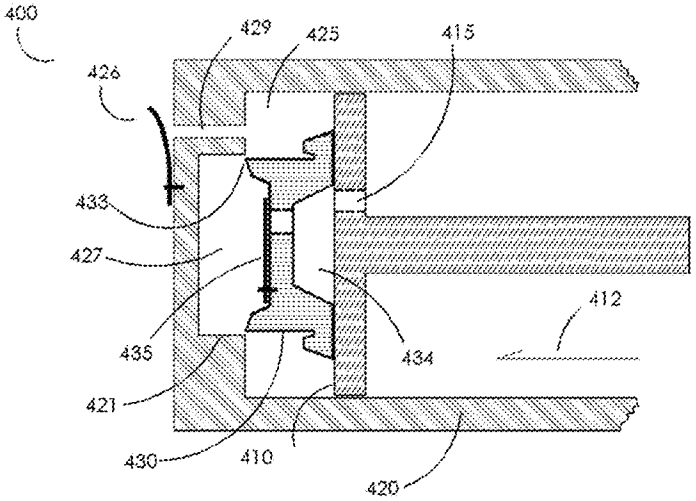

FIG. 4B illustrates the piston 410 moving leftward and nearing the end of a compression stroke 412. Bumper 430 is coupled to piston 410 (e.g., by screwing, welding, snap-fit components, adhesives, etc.) and they travel together. The bumper 430 includes a first structure 433 that is sized to enter a mating second structure 421 at the end of the cylinder compression chamber 425 so that there is ideally no contact between the first and second structures, but close proximity such that compressed gas (e.g., air) is captured in cavity 427 as the piston 410 and bumper 430 advance in the direction shown by arrow 412. This closes cavity 427 containing the pumped fluid, with close tolerances between the bumper and cavity 427, and passively decelerates the piston by the resistive forces of the air compressed within the cavity. Since the piston 410 may require capture and confinement in every stroke, wear is a factor limiting the life of the pumping system. The pneumatic deceleration caused by the interaction of bumper 430 and cavity 427 minimizes or avoids wear of any components, and the energy dissipated from deceleration is imparted as heat and carried away by the pumped fluid (e.g. air). Also noteworthy, the piston 410 may continue to perform useful pumping work by compressing fluid in chamber 425 which may exit through port 429 and open one-way valve 426, despite the beginning of the decelerating action of cavity 427.

Figure 4C:
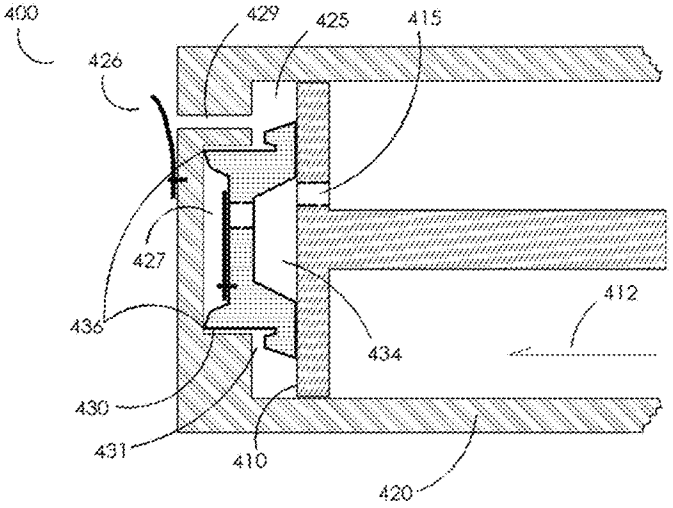

FIG. 4C illustrates further advancing of the piston 410 in cylinder 420 and bumper 430 into cavity 427 during a compression stroke 412. In this view, the bumper 430 is just beginning to contact the head or end of cylinder 420 at location 436 (in three-dimension, this is ideally a round line-of-contact.) The mode of deceleration upon further advancing transitions to deformation of the bumper 430 itself. In one embodiment, bumper 430 comprises silicone, which is resilient to creep when stored in a deflected state, although other materials including other polymers may be used. Deformation of bumper 430 may continue with further travel due to the spacing at 431, and useful pumping in chamber 425, through port 429 and cylinder one-way valve 426, continues during the bumper-deflection phase of deceleration.

Figure 4D:
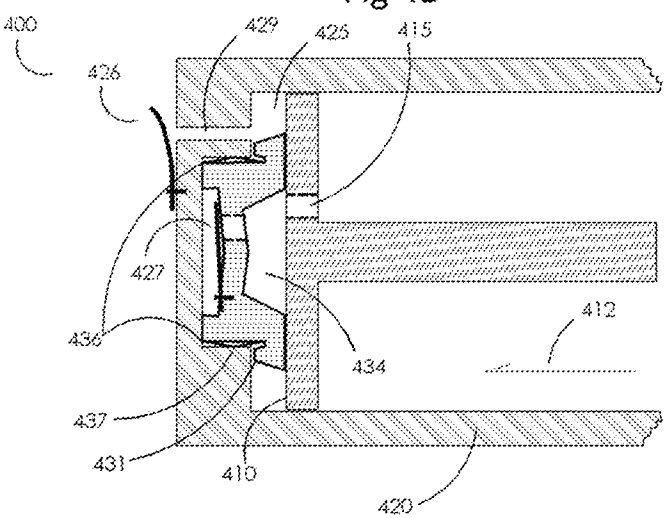

FIG. 4D illustrates further advancement of piston 410 such that the gap at location 431 is closed. Contact points 436 may deflect in a manner which retains pumped fluid in chamber 427 during deflection. This trapped fluid causes deceleration energy to be transferred into the pumped medium (e.g., air) in the form of heat, which is removed as the pressure is reduced through the action of the piston 410 reversing its direction of travel as an intake stroke begins. Also, the deflection occurs in a manner which does not result in friction wear as the contact points 436 and the bumper 430's compressive strain results in widening 437 against the mating structure 421—these movements occur in directions more-or-less normal to their points of contact to minimize abrasion of the bumper/cylinder. Any remaining energy to be dissipated may occur via deflection of bumper structures 431. These structures are positioned on the outer perimeter to maximize contact area/volume of the bumper 430. The remaining energy is converted into heating of the bumper material, and the bumper's geometry is chosen such that flow of the pumped medium (e.g. airflow) across inner and outer bumper surfaces cools the bumper and carries away heat energy via the pumped-medium.

When it is time to perform an intake stroke and move the piston in the direction 411 shown in FIG. 4A, it will be appreciated that the bumper 430 and piston structure forming cavity 427 would result in a vacuum formation in cavity 427. In one embodiment, bumper air passageway 432 and bumper one-way valve 435 are located in a recess, so that movement in direction 411 is not restricted despite the pneumatic deceleration structures (e.g., 433, 431) of the bumper and cavity 427. In one embodiment (not shown), cylinder compression chamber 425 may fill via elastic lifting of the bumper 430 away from its (preferably planar) interface with the piston 410, allowing air to proceed from the inlet side of piston 410 through passageway 415 and into compression chamber 425.

FIGS. 4A-4D, for simplicity, illustrate one pumping structure; a preferred embodiment utilizes a symmetrically mirrored pumping structure at the other end of the two-cylinder linear motor and pump and such that the one-way directionality of the restriction structures are in opposite directions.

The particular embodiments disclosed and discussed above are illustrative only, as the invention may be modified and practiced in different but equivalent manners apparent to those skilled in the art having the benefit of the teachings herein. Embodiments of the present invention disclosed and claimed herein may be made and executed without undue experimentation with the benefit of the present disclosure. While the invention has been described in terms of particular embodiments, it will be apparent to those of skill in the art that variations may be applied to systems and apparatus described herein without departing from the concept, spirit and scope of the invention. Examples are all intended to be non-limiting. It is therefore evident that the particular embodiments disclosed above may be altered or modified and all such variations are considered within the scope and spirit of the invention, which are limited only by the scope of the claims.

In various embodiments, the present invention relates to the subject matter of the following numbered paragraphs.

101. A system for dispersing energy from contact between a piston and a cylinder head, comprising:

a) a cylinder comprising a cylinder bore comprising a cylinder axis and a cross-sectional shape, and a cylinder head;

b) a piston for reciprocating movement within the cylinder bore, the piston comprising:

1) a first surface generally perpendicular to the first cylinder axis and having the cross-sectional shape; and 2) a peripheral surface adapted to fit slidingly within the cylinder bore;

c) a bumper system to disperse energy from contact between the piston and the cylinder head, comprising:

1) a bumper element coupled to the first surface of the piston; and 2) a mating structure on the first cylinder head, wherein the first bumper element is adapted to engage the mating structure to disperse energy by at least one of A) deformation of at least one of the bumper element and the mating structure; and B) compression of fluid from the cylinder bore in a chamber defined by the engagement of the bumper element and the mating structure.

102. The pump of 101, wherein the bumper element comprises one of a male structure and a female structure, and the mating structure comprises the other of a male structure and a female structure.

103. The pump of 101, wherein the bumper element comprises a resilient material capable of elastic deformation upon contact with the mating element.

104. The pump of 101, wherein the bumper element comprises a resilient material capable of elastic deformation upon contact with the mating element.

105. The pump of 104, wherein the resilient material comprises a silicone polymer.

106. A pump comprising:

a) a pump inlet coupled to a fluid source;

b) at least one cylinder having a cylinder bore defined by a cylinder wall, a cylinder axis, and a cylinder head, wherein the cylinder bore is fluidly coupled to the pump inlet;

d) at least one piston for reciprocating movement within the at least one cylinder, the piston comprising:

1) a first surface generally perpendicular to the cylinder axis; and 2) a peripheral surface adapted to fit slidingly within the cylinder bore;

e) a pump outlet coupled to the cylinder bore; and f) a bumper system to disperse energy from contact between the piston and the cylinder head, comprising:

1) a bumper element coupled to the first surface of the piston; and 2) a mating structure on the first cylinder head, wherein the bumper element is adapted to engage the mating structure to disperse energy by at least one of A) deformation of at least one of the bumper element and the mating structure; and B) compression of fluid from the cylinder bore in a chamber defined by the engagement of the bumper element and the mating structure.

What is claimed is:

1. A pumping system comprising:

a) a pump inlet coupled to a gas fluid medium source;

b) a pump outlet;

c) a first cylinder bore having a first bore axis and a first cross-sectional shape, comprising:

1) a first cylinder wall having a first wall end fluidly coupled to the pump inlet, and a second wall end distal from the first end; and 2) a first cylinder head coupled to the second wall end, having a first one-way valve permitting the gas fluid medium to flow from the first cylinder bore to the pump outlet, and a first mating structure comprising one of a male structure and a female structure;

d) a second cylinder bore having a second bore axis and a second cross-sectional shape, comprising:

1) a second cylinder wall having a first wall end fluidly coupled to the pump inlet, and a second wall end distal from the first end; and 2) a second cylinder head coupled to the second wall end, having a second one-way valve permitting the gas fluid medium to flow from the second cylinder bore to the pump outlet, and a second mating structure comprising one of a male structure and a female structure;

e) a piston assembly that is not attached to a crankshaft extending externally to the first and second cylinder bores, the piston assembly having first and second ends and comprising:

1) a first piston at the first end of the piston assembly for reciprocating movement within the first cylinder bore in alternating compression and intake strokes, comprising:

A) a first surface opposite to the first cylinder head, comprising a first bumper structure having a male or female structure different from the male or female structure of the first mating structure of the first cylinder head, wherein the first bumper structure and the first mating structure are adapted to dissipate energy and decelerate the piston assembly during the compression stroke of the first piston by 1) compression of the gas fluid medium in a cavity defined by the engagement of the first mating structure and the first bumper structure, and 2) deformation of at least one of the first bumper structure and the first mating structure, while allowing at least a portion of the compressed fluid in the cavity to flow from the cavity to the cylinder bore; and B) a peripheral surface having the first cross-sectional shape and adapted to fit slidingly within the first cylinder bore;

2) a second piston at the second end of the piston assembly for reciprocating movement within the second cylinder bore in alternating compression and intake strokes, wherein the intake stroke of the first piston occurs during the compression stroke of the second piston, and the intake stroke of the second piston occurs during the compression stroke of the first piston, the second piston comprising:

A) a second surface opposite to the second cylinder head, comprising a second bumper structure having a male or female structure different from the male or female structure of the second mating structure of the second cylinder head, wherein the second bumper structure and the second bumper structure are adapted to dissipate energy and decelerate the piston assembly during the compression stroke of the second piston by compression of the gas fluid medium in a cavity defined by the engagement of second mating structure and the second bumper structure, while allowing at least a portion of the compressed fluid in the cavity to flow from the cavity to the cylinder bore; and B) a peripheral surface adapted having the second cross-sectional shape and adapted to fit slidingly within the second cylinder bore;

3) a connecting rod coupling the first and second piston ends; and 4) first and second permanent magnets, each of the first and second permanent magnets having a first pole having a first polarity oriented generally toward one of the first and second cylinder heads, and a second pole having a second polarity opposite to the first polarity, the second pole of each of the first and second permanent magnets comprising the same polarity and oriented generally toward the second pole of the other of said first and second permanent magnets; and f) an electromagnetic coil comprising a cylindrical shape having first and second coil ends and a coil axis generally coaxial with at least one of the first bore axis and the second bore axis, the electromagnetic coil couplable to a current source and generating a magnetic field when receiving current from said current source, the electromagnetic field generated by the electromagnetic coil interacting with the first and second permanent magnets to generate forces to cause movement of the piston assembly relative to the first and second cylinder bores.

2. The pumping system of claim 1, wherein the coil windings are exposed to and cooled by the fluid passing from the pump inlet to one of the first and second cylinders.

3. The pumping system of claim 1, wherein the first piston and the first cylinder bore define a first fluid chamber for movement of fluid from the fluid source to the pump outlet via the first one-way valve during the compression stroke of the first piston, and the second piston and the second cylinder bore define a second fluid chamber for movement of fluid from the fluid source to the pump outlet via the second one-way valve during the compression stroke of the second piston.

4. The pumping system of claim 3, wherein the first piston comprises a first aperture and a third one-way valve coupling the pump inlet to the first fluid chamber during the intake stroke of the first piston, and the second piston comprises a second aperture and a fourth one-way valve coupling the pump inlet to the second fluid chamber during the intake stroke of the second piston.

5. The pumping system of claim 1 wherein all moving elements of the piston assembly are radially symmetrical.

6. The pumping system of claim 1 wherein all moving elements of the piston assembly are rotationally unconstrained about the linear axis of travel.

7. The pumping system of claim 1, further comprising:

g) first and second motor core rings, wherein each motor core ring is coaxial with the electromagnetic coil, the first motor core ring disposed adjacent to the first coil end and the second motor core ring disposed adjacent to the second coil end.

8. The pumping system of claim 7, further comprising:

h) one or more motor core cross-bars electromagnetically coupling the first and second motor core rings.

9. A pump comprising:

a) a pump inlet coupled to a gas fluid medium source;

b) a pump outlet;

c) a cylinder comprising a cylinder bore having a bore axis and a cross-sectional shape, comprising:

1) a cylinder wall having a first end fluidly coupled to the pump inlet and a second end distal from the first end; and 2) a cylinder head coupled to second end and having a first one-way valve permitting the gas fluid medium to flow from the first cylinder bore to the pump outlet, and a mating structure comprising one of a male structure and a female structure;

d) a piston for reciprocating movement within the cylinder bore in alternating compression and intake strokes, comprising:

1) a first surface opposite to the cylinder head, comprising a bumper having a male or female structure different from the male or female structure of the mating structure, wherein A) one of the mating structure and the bumper comprises a female structure having a first wall, and the other of the mating structure and the bumper structure comprises a male structure having a second wall adapted to fit within the female structure;

B) the male and female structures are adapted to dissipate energy and decelerate the piston during the compression stroke of the piston by compression of the gas fluid medium in a cavity defined by the engagement of the male and female structures; and C) the male and female structures have tolerances selected to permit at least a portion of the gas fluid medium compressed in the cavity to to flow from the cavity, via the first and the second wall, into the cylinder bore and through the first one-way valve to the pump outlet; and 2) a peripheral surface having the cross-sectional shape and adapted to fit slidingly within the cylinder bore.

10. The pump of claim 9, wherein at least one of the mating structure and the bumper comprises a resilient material capable of elastic deformation upon contact with the other of the at least one of the mating structure and the bumper.

11. The pump of claim 9, wherein the resilient material comprises silicone.

12. The pump of claim 9, wherein the bumper incorporates a second one-way flow valve adapted to close during the compression stroke of the piston and open during the intake stroke.

13. A pump comprising:

a) a pump inlet coupled to a gas fluid medium source;

b) a pump outlet;

c) at least one cylinder, comprising:

1) a first cylinder bore comprising a cylinder wall having a proximal end fluidly coupled to the pump inlet, a distal end, a first bore axis, and a first cross-sectional shape;

2) a first cylinder head coupled to the distal end of the first cylinder bore and having a first one-way valve permitting the gas fluid medium to flow from the first cylinder bore to the pump outlet, and a first mating structure comprising one of a male structure and a female structure;

3) a second cylinder bore comprising a cylinder wall having a proximal end fluidly coupled to the pump inlet, a distal end, a second bore axis, and a second cross-section shape;

4) a second cylinder head coupled to the distal end of the second cylinder bore and having a second one-way valve permitting the gas fluid medium to flow from the second cylinder bore to the pump outlet, and second mating structure comprising one of a male and a female structure;

d) at least one piston assembly, comprising:

1) a first piston for reciprocating movement within the first cylinder bore in alternating compression and intake strokes, the first piston comprising:

A) a first surface opposite to the first cylinder head, comprising a first bumper having one of a male and a female structure different from the male or female structure of the first mating structure, wherein 1) at least one of the first mating structure and the first bumper comprises a resilient material capable of elastic deformation upon contact with the other of the at least one of the first mating structure and first bumper;

2) the first mating structure and first bumper are adapted to dissipate energy and decelerate the first piston during the compression stroke of the first piston by compression of the gas fluid medium in a first cavity defined by the engagement of the first mating structure and the first bumper; and 3) the first mating structure and first bumper structure have tolerances permitting at least a portion of the gas fluid medium in the first cavity to exit the cavity into the first cylinder bore; and B) a peripheral surface having the first cross-sectional shape and adapted to fit slidingly within the first cylinder bore;

2) a second piston for reciprocating movement within the second cylinder bore in alternating compression and intake strokes, the second piston comprising:

A) a second surface opposite to the second cylinder head, comprising a second bumper having one of a male and a female structure different from the male or female structure of the second mating structure, wherein 1) at least one of the second mating structure and the second bumper comprises a resilient material capable of elastic deformation upon contact with the other of the at least one of the second mating structure and second bumper;

2) the second mating structure and second bumper are adapted to dissipate energy and decelerate the second piston during the compression stroke of the second piston by compression of the gas fluid medium in a second cavity defined by the engagement of the second mating structure and the second bumper; and 3) the second mating structure and second bumper have tolerances permitting at least a portion of the gas fluid medium in the second cavity to exit the cavity into the second cylinder bore; and B) a peripherical surface having the second cross-sectional shape and adapted to fit slidingly within the second cylinder bore.

14. The pump of claim 13, wherein the cylinder wall of the first cylinder bore and the cylinder wall of the second cylinder bore are contiguous and co-axial.

15. The pump of claim 13, wherein the first cylinder bore and the second cylinder bore have the same cross-sectional shape.

16. The pump of claim 13, further comprising;

e) a connecting rod coupling the first piston and the second piston;

f) at least first and second permanent magnets on the at least one piston assembly, each of the first and second permanent magnets having a first pole having a first polarity oriented generally toward one of the first and second cylinder heads, and a second pole having a second polarity opposite to the first polarity, the second pole of each of the first and second permanent magnets comprising the same polarity and oriented generally toward the second pole of the other of said first and second permanent magnets; and g) an electromagnetic coil comprising a cylindrical shape having first and second coil ends and a coil axis generally coaxial with at least one of the first bore axis and the second bore axis, the electromagnetic coil couplable to a current source and generating a magnetic field when receiving current from said current source, the electromagnetic field generated by the electromagnetic coil interacting with the first and second permanent magnets to generate forces to cause movement of the piston assembly relative to the first and second cylinder bores.

17. The pump of claim 13, wherein the at least one cylinder comprises at least a first cylinder and a second cylinder, wherein the first cylinder comprises the first cylinder bore and the first cylinder head, and the second cylinder comprises the second cylinder bore and the second cylinder head; and wherein the at least one piston assembly comprises a first piston assembly comprising the first piston for reciprocating movement within the first cylinder and a second piston assembly comprising the second piston for reciprocating movement within the second cylinder.

* * * * *